United States Patent [19]

Khaja et al.

[11] Patent Number: 4,479,047

[45] Date of Patent: Oct. 23, 1984

[54] SPLIT BARREL ELECTRIC HAIR CURLER/STYLER

[75] Inventors: Farees U. Khaja, Chicago; Robert O. Ernest, Oak Park; Jerry P. Gronwick, Park Ridge; Howard A. Bristol, Dolton, all of Ill.

[73] Assignee: Sunbeam Corporation, Oak Brook, Ill.

[21] Appl. No.: 397,331

[22] Filed: Jul. 12, 1982

[51] Int. Cl.[3] ..... A45D 1/02; H05B 3/02

[52] U.S. Cl. ..... 219/225; 132/9; 132/31 R; 132/32 R; 132/34 R; 132/37 R; 219/230; 219/533

[58] Field of Search ..... 219/222-226, 219/230, 533; 132/9, 11 R, 117, 118, 31 R, 32 R, 34 R, 37 R, 37 A

[56] References Cited

U.S. PATENT DOCUMENTS

| | | | |
|---|---|---|---|
| 539,340 | 5/1895 | Broomall | 132/37 R |
| 1,056,987 | 3/1913 | Gough | 219/222 X |
| 1,117,021 | 11/1914 | Frey | 132/37 R |
| 1,623,630 | 4/1927 | Martin | 132/37 R |
| 1,820,498 | 8/1931 | Rowley | 132/34 R |
| 1,924,939 | 8/1933 | McCandless | 132/37 R |
| 4,151,850 | 5/1979 | Nathe et al. | 132/37 R |

*Primary Examiner*—A. Bartis

*Attorney, Agent, or Firm*—Clifford A. Dean; Neil M. Rose; Robert J. Fox

[57] ABSTRACT

An electrically heated curler/styler includes an elongated handle having a rotatable elongated longitudinally split heating barrel projecting from the forward end thereof and defining a longitudinal space, open at its forward end, between the split portions of the barrel. A non-rotatable elongated flat blade-like clamp fixed to the forward end of the handle projects into the space between the split portions of the barrel, each of which is provided with a separate internal electric heater. The handle is provided with a button for manually rotating the split barrel from a first position wherein the longitudinal edge of the split barrel portions are spaced from the longitudinal edges of the clamp so that strands of hair can be inserted therebetween and a second position wherein the inserted hair strands are clamped between the longitudinal edges of the clamp and the split barrel portions for curling and/or styling. The split barrel portions are normally biased to the second position by a torsion spring in the handle. The rotatable split barrel arrangement eliminates the difficulty in releasing the finished curl.

14 Claims, 11 Drawing Figures

SPLIT BARREL ELECTRIC HAIR CURLER/STYLER

BACKGROUND OF THE INVENTION

Most of the known curler/stylers of the curling iron type marketed to date are characterized by a heated cylindrical barrel and by a clip or clamp which has a transverse curvature complementary to that of the cylindrical barrel and which is pivotally mounted at one of its ends on the end of the handle from which the heated barrel projects. There is no real problem when the clamp is pivoted open to trap hair between the barrel and the clamp after which the curl is formed by rotating the curler/styler toward the scalp. However, there can be difficulty in pivoting the clamp open to release the finished curl inasmuch as the curl is formed around the clamp with varying degrees of tightness.

A curler/styler which is not characterized by this difficulty, as a result of elimination of the external pivotally mounted clamp, and which is no more costly than the curler/stylers currently on the market should find immediate acceptance, particularly if same also speeds up the curling/styling procedure by more rapid heating of the hair being curled/styled.

SUMMARY OF THE INVENTION

The present invention is directed to a curler/styler having a longitudinally split heating barrel which is rotatable about a longitudinal axis relative to a handle upon which it is mounted. The split heating barrel is also rotatable relative to a blade-like clamp which is non-rotatably mounted in the handle and which extends between the split portions of the heating barrel, each of which portion has a separate internal heater, whereby to releasably clamp strands of hair to be curled/styled between engageable longitudinal edges of the split barrel portions and the clamp. The split barrel portions are normally biased into clamping engagement with the fixed clamp but a manually operable button is provided on the handle for overcoming the resilient means and thus disengaging the split barrel portions from clamping engagement with the clamp.

The split barrel curler/styler of the present invention may be economically produced and as same provides more effective heating of the hair, curling/styling operations can be completed in a shorter period of time than with known type curler/stylers of the curling iron type. Also, as previously noted, elimination of the well-known external clamp facilitates removal of the heating barrel structure from completed curls, again improving the operational time in curling/styling operations.

DETAILED DESCRIPTION OF THE INVENTION

Figures 1, 2, 3:
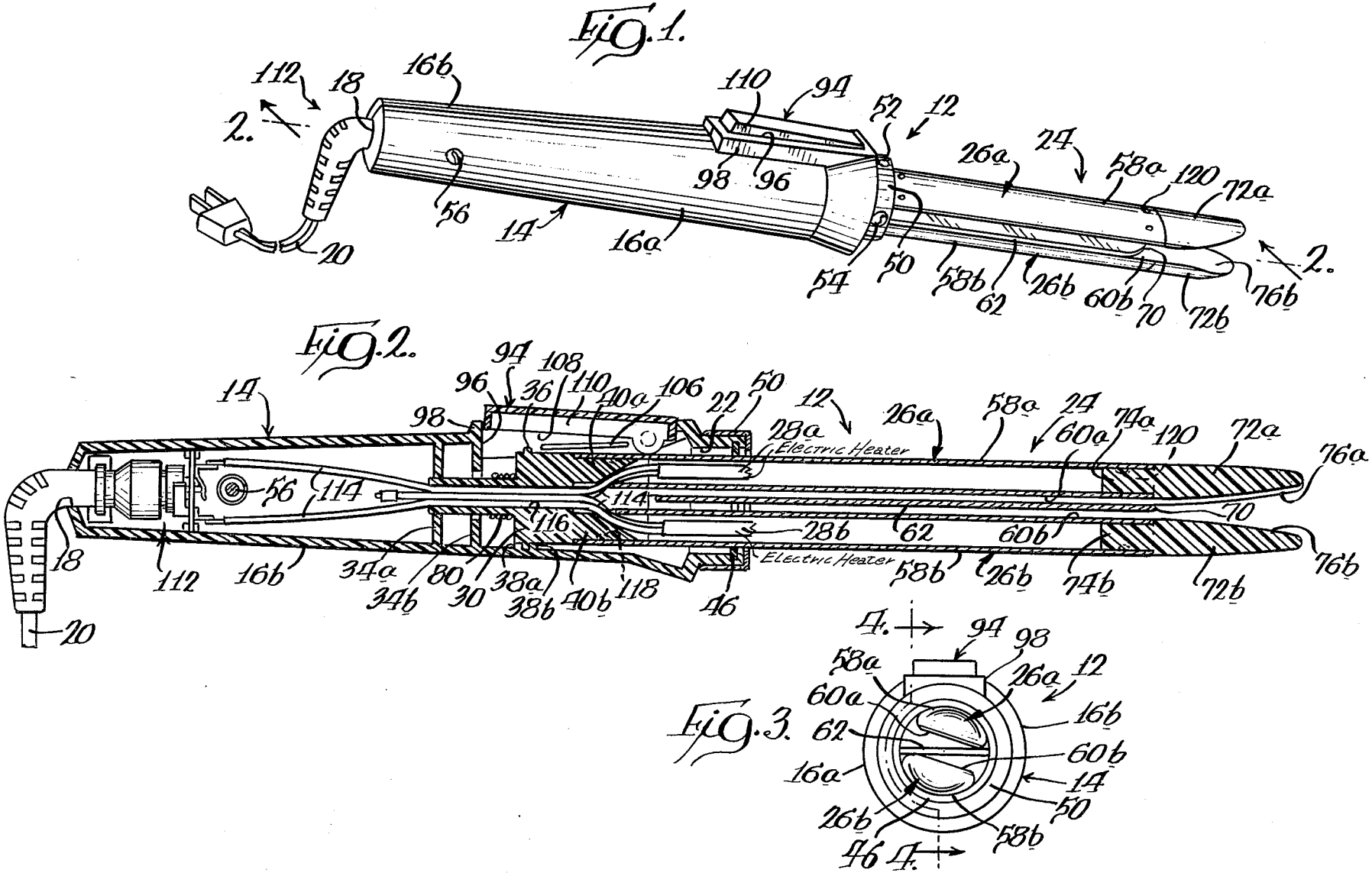
FIG. 1 is a perspective view of a split barrel curler/styler embodying the invention.
FIG. 2 is an enlarged longitudinal vertical sectional view taken generally along the line 2—2 of FIG. 1.
FIG. 3 is a front and elevational view.

A split barrel curler/styler 12 embodying the invention is illustrated in FIG. 1. It is noted that the curler/styler 12 does not incorporate an external hair clamping member of the type normally associated with curling iron curler/stylers. The curler/styler 12 is characterized by a handle 14 formed by a pair of substantially identical plastic-formed housing halves **16*a* and 16*b* which are disposed in side-by-side facing relationship. An opening 18 is defined at the rear end of the handle 14 for a power cord 20. An opening 22 is also defined at the forward end of the handle 14 from which projects a longitudinally split heating barrel 24 which is characterized by a pair of hollow, semi-cylindrical heating barrel portions 26*a* and 26*b*, each of which is formed of aluminum and each of which is provided with its own internal rope heater 28*a* and 28*b* of a type well known in the curling iron art. Obviously, other known type heaters may be substituted for the rope heaters 28*a* and 28*b***.

Figures 4, 5, 6, 7:
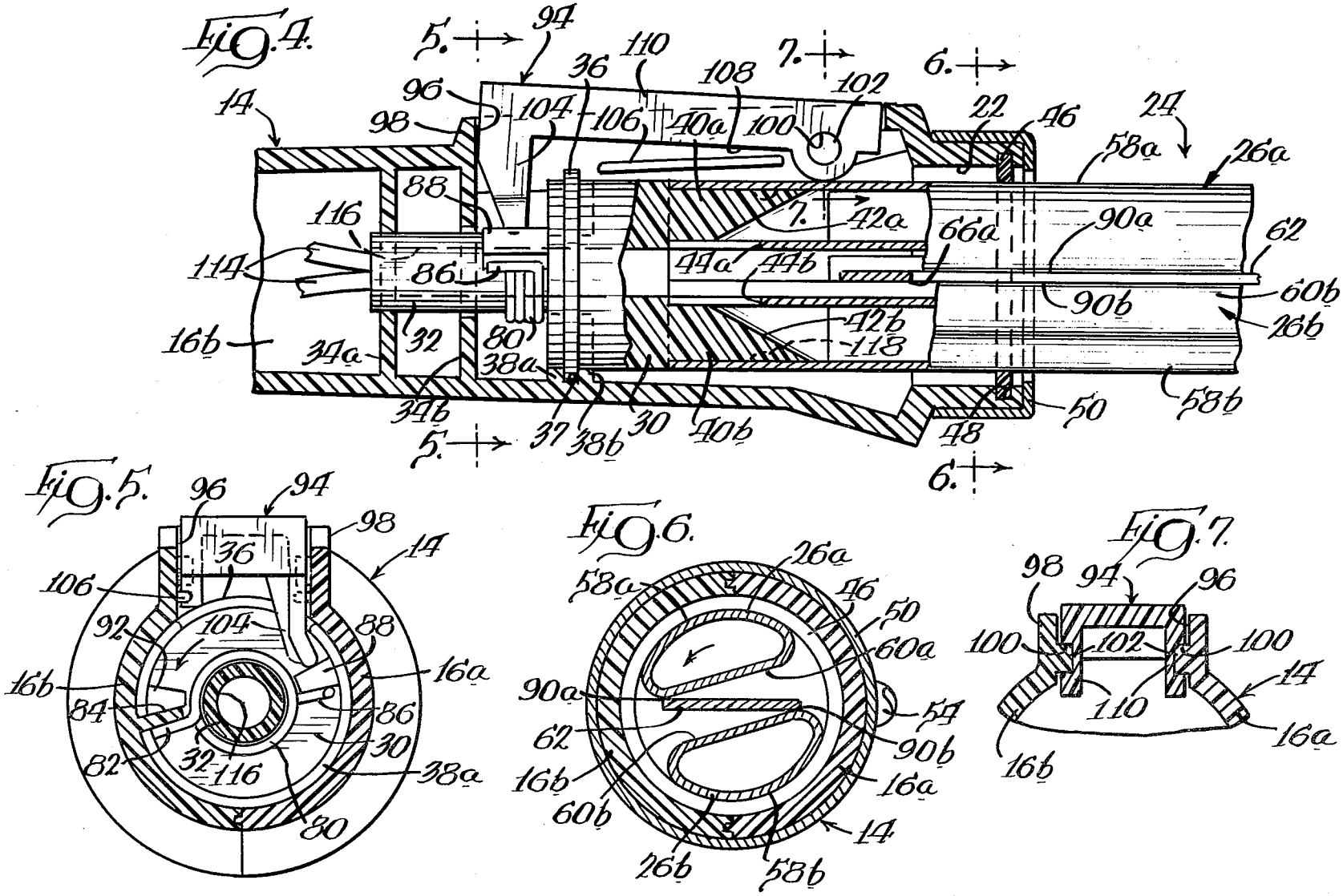
FIG. 4 is an enlarged partial vertical sectional view taken generally along the line 4—4 of FIG. 3 with the clamping members in their normal engaged mode.
FIG. 5 is a vertical sectional view taken generally along the line 5—5 of FIG. 4.
FIG. 6 is a vertical sectional view taken generally along the line 6—6 of FIG. 4.
FIG. 7 is a fragmentary vertical sectional view taken generally along the line 7—7 of FIG. 4.
Figures 8, 9, 10, 11:
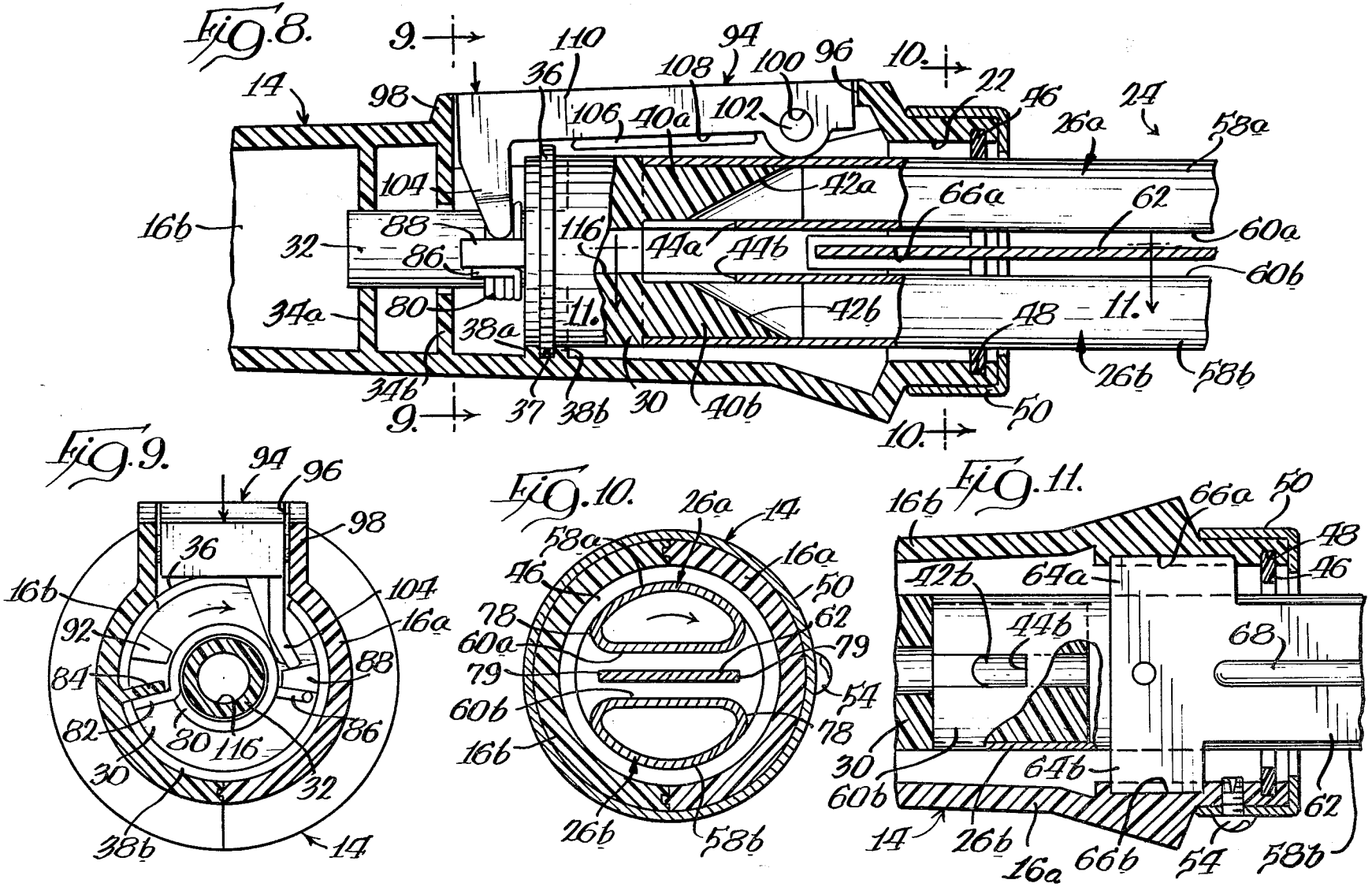
FIG. 8 is a partial vertical sectional view similar to FIG. 4 but with the release button actuated to disengage the clamping members.
FIG. 9 is a vertical sectional view taken generally along the line 9—9 of FIG. 8.
FIG. 10 is a vertical sectional view taken generally along the line 10—10 of FIG. 8.
FIG. 11 is a fragmentary horizontal sectional view taken generally along the line 11—11 of FIG. 8.

As is best illustrated in FIGS. 2, 4 and 8, the two generally semi-cylindrical heating barrel portions **26*a* and 26*b* are mounted on a rotor 30 formed of heat resistant plastic material which is mounted for rotation in the forward end of the handle 14 and which is characterized by a rearwardly extending axial stem portion 32. A pair of axially spaced webs 34*a* and 34*b* formed on the inner surfaces of the housing halves 16*a* and 16*b* provide rotational support for the stem portion 32 of the rotor 30 and an annular flange 36 formed on the main body portion of the rotor 30 is rotatably supported in an annular groove 37 defined between a pair of spaced webs 38*a* and 38*b* which are also formed on the inner surfaces of the housing halves 16*a* and 16*b***.

The pair of generally semi-cylindrical heating barrels **26*a* and 26*b* each has its rear end securely mounted over a pair of integral mounting projections 40*a* and 20*b* formed on the front of the rotor 30, which projections 40*a* and 40*b* are characterized by forwardly diverging inclined surfaces 42*a* and 42*b*, as best shown in FIGS. 2, 4, 8 and 11. Rearwardly opening longitudinally extending slots 44*a* and 44*b* are provided in each of the split barrel portions 26*a* and 26*b*, respectively, adjacent the inclined surfaces 42*a* and 42*b* of the projections 40*a* and 40*b***, for a purpose to be described hereinafter.

The split heating barrel 24 extends forwardly through an insulated centering ring 46 formed of a suitable plastic material which is fitted in an annular groove 48 defined in the forward end of the handle 14 by the two housing halves **16*a* and 16*b*. The forward ends of the handle housing halves 16*a* and 16*b* are held together by a collar 50 which has a known-type ready dot 52 provided thereon, as best shown in FIG. 1. The ready dot 52, as is well known in the personal care field, is a special paint formulation which is applied as a dot on a heatable metallic portion of hair curlers, curling irons, etc. and which changes color from red to black as the temperature increases to a pre-set temperature whereby to provide an indication to the user that the hair curler, curling iron, etc. has reached a suitable temperature for use. The collar 50 is secured to the handle housing half 16***a* by a small set screw 54. The rear portion of the handle housing halves 16*a* and 16*b* are held together by a suitable fastener 56, as shown in FIGS. 1 and 2.

The two generally semi-cylindrical split heating barrel portions 26*a* and 26*b* are characterized by curved outer surfaces 58*a* and 58*b*, respectively, and by generally planar, parallel, spaced apart facing surfaces 60*a* and 60*b*, the previously mentioned slots 44*a* and 44*b* being formed in the planar surfaces 60*a* and 60*b*, respectively.

It is noted that the rotor 30 and the split heating barrel 24 supported thereon are rotatably mounted in the forward end of the handle 14 but, as will be described hereinafter, this rotation is limited to just a few degrees. An elongated, generally flat blade-like clamp 62 has its rear end fixed or nonrotatably mounted in the front end of the handle 14 in a manner such that the blade-like clamp 62 extends forwardly between the planar facing surfaces 60*a* and 60*b* of the pair of the split heating barrel portions 26*a* and 26*b*. For non-rotatably securing the rear end of the blade-like clamp 62 in the handle 14, the rear end thereof is provided with a pair of transversely extending flanges 64*a* and 64*b* which are received in slots 66*a* and 66*b* which are formed, respectively, in the handle housing halves 16*a* and 16*b*, as is best illustrated in FIG. 11. The flange portion 66*b* has a shorter longitudinal dimension than the flange portion 66*a* merely to accommodate the set screw 54. Also, as shown in FIG. 11, the blade-like clamp 62 may be provided with a centrally located longitudinally extending offset strengthening rib 68. As best shown in FIGS. 1 and 2, the blade-like clamp 62 terminates with a curved front edge 70 which is disposed approximately even with the forward ends of the aluminum portions of the semi-cylindrical heating barrel portions 26*a* and 26*b*.

As illustrated in FIGS. 1 and 2, cool tips 72*a* and 72*b*, which are formed of a suitable plastic material, are mounted on the forward ends of the heating barrel portions 26*a* and 26*b*, respectively, and have stem portions 74*a*and 74*b* tightly received in the open forward ends thereof. The cool tips 72*a* and 72*b* are characterized by gently curved facing inner surfaces 76*a* and 76*b*, respectively, which diverge in a forward direction whereby to facilitate entry of strands of hair to be curled/styled therebetween.

As best illustrated in FIGS. 4, 5, 8 and 9, a torsion spring 80 is fitted over the stem portion 32 of the rotor 30. One end 82 of the spring 80 is engaged against a radial projection 84 which is formed on the inner surface of handle housing half 16*b* with the other end 86 of the spring 80 engaging lug 88 which is formed on the rotor. It is noted that the spring 80 biases the rotor-mounted split heating barrel 24 in a direction such that longitudinally extending edges 78 (FIG. 10) of the split barrel portions 26*a* and 26*b* clampingly engage diagonally opposite longitudinal edges 79 (FIG. 10) of the blade-like clamp 62, as shown at 90*a* and 90*b* in FIGS. 4 and 6, whereby to secure strands of hair disposed therebetween. A stop lug 92 is also provided on the rotor 30 which is engageable with the radial projection 84 formed on the inner surface of the handle housing half 16*b* whereby to limit rotation of the split heating barrel 24 as previously set forth herein and as best shown in FIGS. 5 and 9. A few degrees of rotation is all that is necessary for proper operation of the curler/styler 12.

To release the clamping engagement at 90*a* and 90*b*, a release button lever 94 is pivotally mounted in an opening 96 provided in a rectangular formation 98 located on the upper portion of the handle 14. The button lever 94 has an open-bottom, box-like configuration with aligned sockets 100 formed in the forward portions of side walls 110 being adapted to receive trunnion-type pins 102 which are formed on the adjacent inner wall surfaces of the handle housing halves 16*a* and 16*b* for pivotally mounting the button lever 94. An off-center depending actuator 104 is formed on one of the rear corners of the release button lever 94 for engagement, when the button lever 94 is depressed, with the rotor lug 88 whereby to rotate the rotor 30 and the split heating barrel 24 carried thereon against the force of the torsion spring 80 whereby to release the clamping engagement between the split heating barrels 26*a* and 26*b* and the blade-like clamp 62, as is best shown in FIGS. 8, 9 and 10. Elongated stop shoulders 106 formed on the inner-wall surfaces of the handle housing halves 16*a* and 16*b* are engageable by lower edges 108 of the side walls 110 of the button lever 94 to limit downward pivoting movement thereof.

A known-type swivel connector 112 is provided for the power cord 20 at the rear end of the handle 14 with internal leads 114 from the swivel connector 112 passing through a central bore 116 formed in the rotor 30, through the slots 44*a* and 44*b* formed in the split heating barrels 26*a* and 26*b* and along the inclined surfaces 42*a* and 42*b* of the rotor projections 40*a* and 40*b*, respectively, for connection to the rope heaters 28*a* and 28*b*, as is best illustrated in FIG. 2.

The opposite ends of the aluminum semi-cylindrical heating barrel portions 26*a* and 26*b* may be mechanically staked to the rotor projections 40*a* and 40*b* and to the cool tips 72*a* and 72*b*, as at 118 and 120, respectively, as best illustrated in FIGS. 1, 2 and 4.

Operation of the curler/styler 12 is believed obvious from the description thereof herein. As it is normally in its clamped mode, the button lever 94 must first be depressed to convert to the unclamped mode of FIGS. 8 and 10 whereby the strands of hair to be curled/styled are readily inserted between the split barrel portions 26*a* and 26*b* after which the button lever 94 is released (FIGS. 4 and 6). The hair is then curled/styled in the usual manner after which the button lever 94 is again depressed to very simply release the finished curl and permit ready removal of the curler/styler therefrom.

While there has been shown and/or described a preferred embodiment of the present invention, it will be apparent to those skilled in the art that various changes and modifications may be made without departing from the invention in its broader aspects and it is, therefore, contemplated in the appended claims to cover all such additions, changes and modifications that fall within the true spirit and scope of the present invention.

What is claimed as new and desired to be secured by Letters Patent of the United States is:

1. A curler/styler comprising an elongated handle having an elongated longitudinally split heating barrel projecting from the forward end thereof and defining a longitudinal space between the split portions of the barrel, said space being open at its forward end, and an elongated generally flat blade-like clamp projecting from said forward end of said handle in said space between the split portions of said heating barrel, said split heating barrel and said clamp being rotatable relative to one another about a longitudinal axis between a first position wherein the split portions of the barrel are spaced from the clamp so that strands of hair can be inserted therebetween and a second position wherein the inserted hair strands are clamped between engaged longitudinal edges of the split barrel portions and the clamp, and means for selectively rotating said barrel and clamp relative to each other.

2. The curler/styler of claim 1 wherein each portion of said split barrel has a generally semi-cylindrical configuration and wherein generally planar surfaces thereof face one another in parallel, spaced-apart relationship.

3. The curler/styler of claim 1 wherein said blade-like clamp is fixedly mounted relative to said handle and wherein said split heating barrel has a rotor portion mounted in said handle for rotation relative thereto about said longitudinal axis.

4. The curler/styler of claim 3 wherein resilient means is provided between said handle and said rotor portion for normally biasing said split barrel portions into clamping engagement with diagonally opposite longitudinal edges of said blade-like clamp.

5. The curler/styler of claim 4 wherein said means for selectively rotating said barrel and clamp relative to each other comprises manually engageable means for rotating said rotor against the force of said resilient means whereby to release said split barrel portions from said clamping with said clamp.

6. A curler/styler comprising an elongated handle having an elongated longitudinally split heating barrel projecting from the forward end thereof and adapted for limited rotation relative thereto, said split barrel defining a longitudinal space between the split barrel portions which is open at its forward end, an elongated, generally flat blade-like clamp projecting from said forward end of said handle and disposed in said space between the split portions of said heating barrel, said clamp being non-rotatable relative to said handle, said split heating barrel being rotatable relative to said clamp about a longitudinal axis between a first position wherein the split portions of the barrel are spaced from the clamp so that strands of hair can be inserted therebetween and a second position wherein the inserted hair strands are clamped between engaged longitudinal edges of the split barrel portions and said clamp, means for selectively rotating said barrel and clamp relative to each other, and means for internally heating both portions of said split heating barrel.

7. The curler/styler of claim 6 wherein each portion of said split barrel has a generally semi-cylindrical configuration and wherein generally planar surfaces thereof face one another in parallel, spaced-apart relationship.

8. The curler/styler of claim 6 wherein resilient means is provided between said handle and said split heating barrel for normally biasing said split barrel portions into clamping engagement with diagonally opposite longitudinal edges of said blade-like clamp.

9. The curler/styler of claim 8 wherein said means for rotating said barrel comprises a manually operable button on said handle for rotating said split heating barrel against the force of said resilient means whereby to release said split barrel portions from said clamping engagement with said clamp.

10. A curler/styler comprising a generally hollow handle portion having an open forward end, a rotor mounted in said open forward end for rotation about a longitudinal axis, said rotor having a pair of elongated, generally semi-cylindrical heating barrels projecting forwardly therefrom and adapted for rotation with said rotor, said semi-cylindrical barrels having planar surfaces facing one another in parallel, spaced apart relationship, means for internally heating each of said semi-cylindrical barrels, an elongated generally flat blade-like clamp having its rear end non-rotatably secured in the forward end of said handle and projecting forwardly between said planar surfaces of said semi-cylindrical heating barrels in spaced relationship thereto, resilient means biasing said rotor in a direction such that edge portions of each of said semi-cylindrical heating barrels normally engage diagonally opposite longitudinal edges of said blade-like clamp for clamping therebetween strands of hair to be curled/styled, and manually operable control means on said handle for rotating said rotor in a direction against the action of said resilient means whereby to disengage said semi-cylindrical heating barrels from engagement with said blade-like clamp whereby to permit either the entry of strands of hair to be curled/styled or the withdrawal of curled/styled hair into or from the space between said barrels and said clamp.

11. The curler/styler of claim 10 wherein said rotor is provided with a rearwardly extending concentric stem portion, wherein said resilient means is in the form of a torsion spring fitted over said stem portion and having one end engaged with a lug provided on said rotor and having the other end engaged with a projection provided on the inner surface of said handle, and wherein said manually operable control means comprises a button lever which is pivotally mounted on said handle and which has an off-center depending actuator which is engageable with said rotor lug to rotate said rotor and said semi-cylindrical heating barrels against the force of said torsion spring to disengage said barrels from said clamp.

12. A curler/styler comprising a generally hollow handle portion having a power cord projecting into the rear end thereof and having an open forward end, a rotor mounted in said open forward end for limited rotation about a longitudinal axis, said rotor having a pair of diametrically opposite, spaced apart, forwardly extending mounting projections, a pair of elongated generally semi-cylindrical hollow heating barrels mounted on said projections for rotation with said rotor and having planar surfaces facing each other in spaced apart parallel relationship, heater means in each of said semi-cylindrical barrels connected to said power cord, a generally flat blade-like clamp having its rear end non-rotatably secured in the forward end of said handle and projecting forwardly between said semi-cylindrical heating barrels in spaced relationship thereto, resilient means biasing said rotor in a direction such that an edge portion of each of said semi-cylindrical heating barrels normally engage diagonally opposite longitudinal edges of said blade-like clamp for clamping therebetween strands of hair to be curled/styled, and manually engageable control means on said handle for rotating said rotor in a direction against the action of said resilient means whereby to disengage said semi-cylindrical heating barrels from engagement with said blade-like clamp whereby to permit either the entry of strands of hair to be curled/styled or the withdrawal of curled/styled hair into or from the space between said barrels and said clamp.

13. The curler/styler of claim 12 wherein said mounting projections have forwardly diverging inclined surfaces, wherein inner facing surfaces of the rear portions of said semi-cylindrical hollow heating barrels are each provided with a longitudinally extending slot adjacent each of said inclined surfaces of said mounting projections, and wherein said rotor is centrally bored, whereby leads connected to said power cord pass through said centrally bored rotor and through said heating barrel slots and along said inclined mounting-projection surfaces into said pair of semi-cylindrical heating barrels for connection to said heater means therein.

14. A curler/styler comprising an elongated handle having an elongated longitudinally split heating barrel projecting forwardly from a centrally bored rotor mounted for rotation in the open front end of said handle, said split barrel defining a longitudinal space between the split barrel portions which is open at its forward end, an elongated generally flat blade-like clamp mounted in said forward end of said handle and extending in said space between the split portions of said heating barrel, said split heating barrel and said clamp beng rotatable relative to one another about a longitudinal axis between a first position wherein the split portions of the barrel are spaced from the clamp so that strands of hair can be inserted therebetween and a second position wherein the inserted hair strands are clamped between engaged longitudinal edges of the split barrel portions and said clamp, means for selectively rotating said barrel and clamp relative to each other, heater means in each portion of said split heating barrel with a slot being formed in the rear end of each barrel portion adjacent said rotor, a power cord extending into the rear end of said handle and having leads extending through said bored rotor and through said barrel portion slots for connection to said heater means, and a cool tip mounted on the forward end of each split barrel portion and having gently curved, facing inner surfaces which diverge in a forward direction.

* * * * *